US007305098B2

(12) United States Patent
Vonlanthen et al.

(10) Patent No.: US 7,305,098 B2
(45) Date of Patent: Dec. 4, 2007

(54) HEARING DEVICE

(75) Inventors: Andi Vonlanthen, Remetschwil (CH); Hilmar Meier, Zürich (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 10/155,000

(22) Filed: May 24, 2002

(65) Prior Publication Data

US 2003/0219138 A1 Nov. 27, 2003

(51) Int. Cl.
*H04R 25/00* (2006.01)

(52) U.S. Cl. ..... 381/312; 381/328; 381/353; 381/371

(58) Field of Classification Search ..... 381/345, 381/346, 349, 350, 351, 91, 371, 92, 429, 381/353, 354, 312, 328, 380; 181/129, 160, 181/135

See application file for complete search history.

(56) References Cited

U.S. PATENT DOCUMENTS 3,246,721 A * 4/1966 Martin ..... 181/160
4,637,489 A * 1/1987 Iwanaka ..... 181/160
4,742,887 A * 5/1988 Yamgishi ..... 381/345
5,319,717 A 6/1994 Holesha

FOREIGN PATENT DOCUMENTS

| | | |
|---|---|---|
| EP | 0 455 203 A2 | 11/1991 |
| WO | 00 79832 A1 | 12/2000 |
| WO | 00 79835 A1 | 12/2000 |

* cited by examiner

*Primary Examiner*—Huyen Le
(74) *Attorney, Agent, or Firm*—Pearne & Gordon LLP

(57) ABSTRACT

A hearing device has an electrical/acoustical output converter that communicates with ambient air through a membrane. The membrane separates two spaces. Each space communicates with ambient air through a passage that substantially blocks acoustical signals in the range of the audible spectrum and passes acoustical signals at a frequency lower than the audible spectrum.

16 Claims, 3 Drawing Sheets

HEARING DEVICE

The present invention is directed to a hearing device with an electrical/acoustical output converter whereby the output converter communicates with ambient via at least one membrane separating two spaces. It is also directed to a hearing device with an acoustical/electrical input converter which communicates with ambient via at least one membrane which separates two spaces.

Such hearing devices may be any kind of devices for improving hearing of an individual but are especially hearing aid devices. Thereby, such hearing aid devices may be in-the-ear or outside-the-ear devices.

Figure 1:
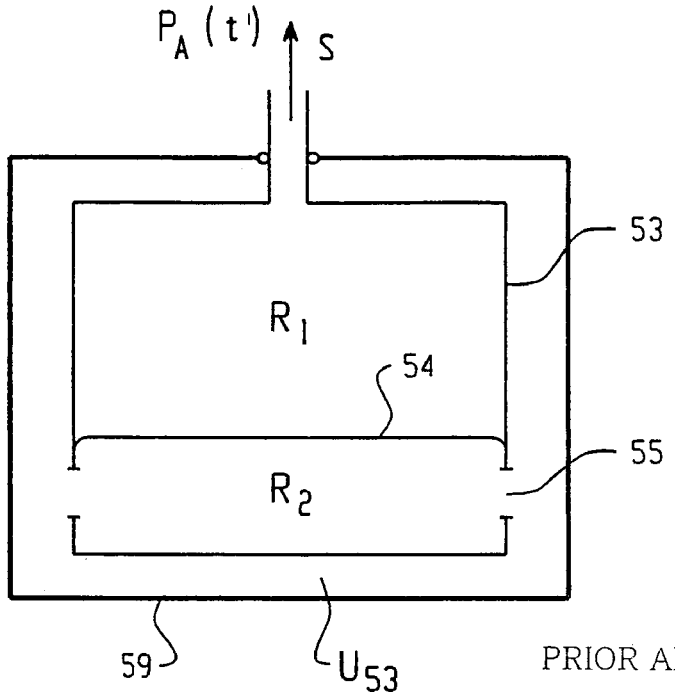
PRIOR ART Fig. 1

The point of departure of the present invention shall be described with the help of figures. In the WO 00/79835 which accords to the U.S. application Ser. No. 09/340,915 there is known for a hearing device an electrical/acoustical output converter as schematically shown in FIG. 1. A membrane 54 of the output converter, a loudspeaker, is provided within a housing 53 and separates a first space $R_1$ from a second space $R_2$. The first space $R_1$ is coupled to the acoustical output of the hearing device as it is shown with S and thus to ambient. An encapsulation 59 forms with the housing 53 an inter-space $U_{53}$. The second space $R_2$ communicates with that inter-space by means of openings 55. A motorical drive (not shown) drives the membrane 54 and is coupled between the housing 53 and the membrane 54.

Thereby the membrane 54 separates, as was said, two spaces wherefrom one space, $R_2$, does not communicate with ambient whereas space $R_1$ does via the acoustical output as shown by S.

Figure 2:
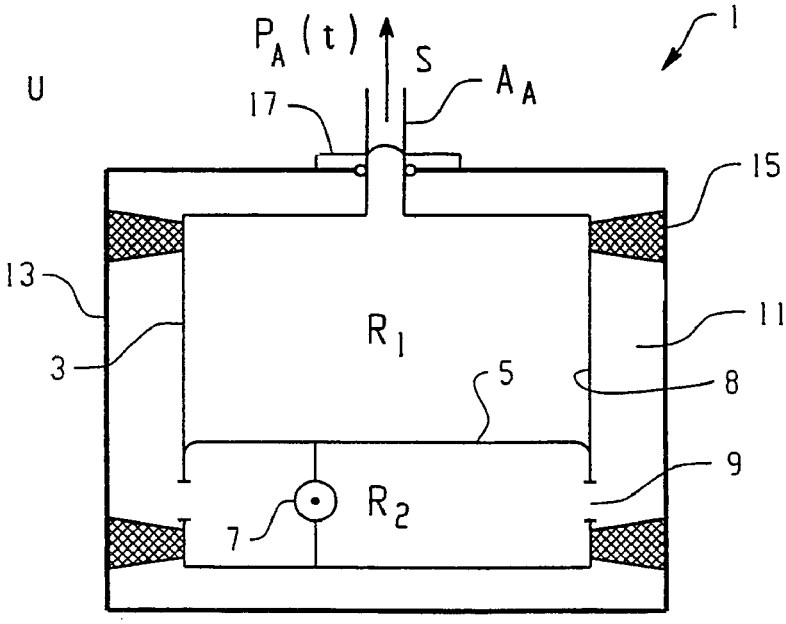
PRIOR ART Fig. 2

An improved embodiment of such an electrical/acoustical output converter is shown in FIG. 2 as known from the WO 00/79832 according to the U.S. application Ser. No. 09/587,864. Thereby and as a difference to the embodiment shown in FIG. 1, the space R, which is codefined by membrane 5 communicates with ambient via a freely suspended membrane 17. Here the motoric drive 7 is shown as well as elastic suspensions 15 with which the casing 8 is mounted within encapsulation 13.

Principally both representations are valid also for acoustical/electrical input converters in the hearing device if the motoric drive 7 as of FIG. 2 is replaced by an electrical pick-up which converts the mechanical movement of membrane 5 into an electrical output signal.

In both output converter embodiments as well as in the respective input converter embodiments the membrane 5 or 54 as well as the membrane 17 may be tailored to substantially contribute to the acoustical impedance, either on the output side of an electrical/acoustical output Converter or at the input side of an acoustical/electrical input converter. In dependency of the tension, the material, the thickness, the shaping etc. of the respective membrane it does significantly contribute to the input or output acoustical impedance of the respective converter. With the membrane 17 as shown principally in FIG. 2 several advantages are realized as they are described in the WO 00/79832 and the respective US-application.

When such membranes do considerably contribute to the overall acoustical input or output impedance in a desired and predetermined manner, it is important that the status of such membrane is kept constant over time. According to FIG. 1 whereat space $R_1$ freely communicates with ambient, a varying atmospheric pressure $P_A$ (t) will change the tension of membrane 54 thereby possibly also the working point of the motoric drive or of the pick-up, in the case of an acoustical/electrical converter, because the space $R_1$ on the back side of the membrane 54 is hermetically sealed and the membrane 54 is biased so as to establish within space $R_2$ the same pressure as is prevailing in the space $R_1$, i.e. in ambient.

In the embodiment of FIG. 2 a varying ambient pressure $P_A$ (t) affects the bias status of membrane 17 as well as the bias status of membrane 5, because both spaces $R_1$ and $R_2$ are hermetically sealed with respect to ambient surrounding the hearing device.

It is an object of the present invention to provide for hearing devices as mentioned above whereat the appearing acoustical impedance of the at least one membrane provided is kept constant over time.

At an output converter as mentioned above this is resolved by having both spaces which are separated by the at least one membrane communicating with ambient by at least one respective passage which substantially blocks acoustical signals in the range of hearable spectrum thereby being substantially open for acoustical signals below that range.

We define the frequency range of the hearable system $B_H$ to be:

$$100\ \text{Hz} \leqq B \leqq 25\ \text{kHz}.$$

In the hearing device with the said acoustical/electrical input converter the object as mentioned is resolved by having both spaces separated by the at least one membrane communicating with ambient by at least one respective passage which again substantially blocks acoustical signals in the range of hearable spectrum thereby being substantially open for acoustical signals below that range.

Thus, with an eye on FIG. 1 or 2 principally the present invention resides in establishing from space $R_1$ as well as from space $R_2$ a communication passage to ambient which, considered in terms of acoustical impedance, has a low-pass characteristic thereby allowing pressure equalization between ambient and the respective spaces but only neglectably influencing the overall acoustical impedance behavior in the hearable spectrum range of acoustical signals as defined above.

Thereby the at least one membrane may be mechanically coupled to an electric drive or to a mechanical/electrical pick-up. Further the at least one membrane may be a freely suspended membrane as membrane 17 shown in FIG. 2. This for both inventive hearing devices, namely where the invention is applied to an electrical/acoustical output converter and/or to an acoustical/electrical input converter.

In a preferred embodiment of the inventive hearing devices one of the said two spaces communicate with ambient via a passage through the membrane. Thereby it must be emphasized that such communication may be established by such passage opening directly to ambient or via a further space and passage if following the membrane considered there is provided e.g. a further air space and membrane as shown in FIG. 2.

If according to FIG. 2 space $R_2$ communicates via a passage through membrane 5 with space $R_1$ a further passage from space $R_1$ to ambient has to be established being through membrane 17 or by-passing such membrane 17.

In a further embodiment there is provided at least one passage which bypasses said at least one membrane for establishing communication of at least one of said two spaces with ambient.

So as to establish through said at least one membrane according to the present invention, a passage by which one of the said two spaces communicates with ambient, it is proposed to tailor such at least one passage with a diameter D of $$10\ \mu m \leqq D \leqq 30\ \mu m$$

thereby preferably of $$D = \text{approx. } 20\ \mu m.$$

By such dimensioning the acoustical impedance of such a passage, acting as a low-pass acoustical filter, will not or will not significantly influence the acoustical impedance of the membrane.

In a further preferred embodiment there is provided at least one of such membranes being arranged substantially flush with the outer surface of the housing of the hearing device.

Thereby preferably such membrane provided flush with the said surface is formed by a membrane which is not coupled to a motoric drive of the output converter or to a motion pick-up of an input converter but is conceived as principally shown by membrane 17 in FIG. 2 by a freely suspended membrane. Thereby and with respect to cleaning of the hearing device significant advantages are reached in that no cavity is open towards the respective converter where dirt may accumulate.

If such membrane is conceived exchangeable, cleaning the bearing device may just incorporate replacing such membrane or removing such membrane for cleaning and re-arranging.

As by the measures taken according to the present invention there is reached stability of the acoustical impedance of such membrane over time the possibility is opened to provide such membrane so as to significantly contribute to the input- or respectively output-acoustical impedance of an input or output converter.

So as to accurately predertermine such impedance and especially in the case of such membrane being arranged flush with the outer surface of the casing of the hearing device, in a preferred embodiment such membrane is coated, preferably coated with a metallic layer.

Thereby, further preferred, the coated surface of such membrane and especially of such membrane if arranged flush with the outer surface of the device is applied turned towards the ambient. The coating may thereby improve cleanability but may be especially provided to define for the acoustical impedance of the membrane. A metallic layer coating may thereby act as electrical shield if connected to a reference electric potential of the electronics provided within the hearing device.

Further preferably the at least one membrane is made of silicon or of polyurethane especially if the addressed membrane is not the membrane coupled to the motoric drive of the output converter or to the mechanical/electrical pick-up or sensor of an input converter but is provided as a freely suspended membrane as of membrane 17 according to FIG. 2.

In a preferred realization form the above addressed hearing devices are hearing aid devices thereby either in-the-ear hearing devices or outside-the-ear hearing devices.

The invention shall now be further described by means of examples by the following figures. The figures show:

FIG. 1: Schematically a prior art electrical/acoustical converter.

FIG. 2: In a representation in analogy to that of FIG. 1 an improved prior art electrical/acoustical converter.

Figure 3:
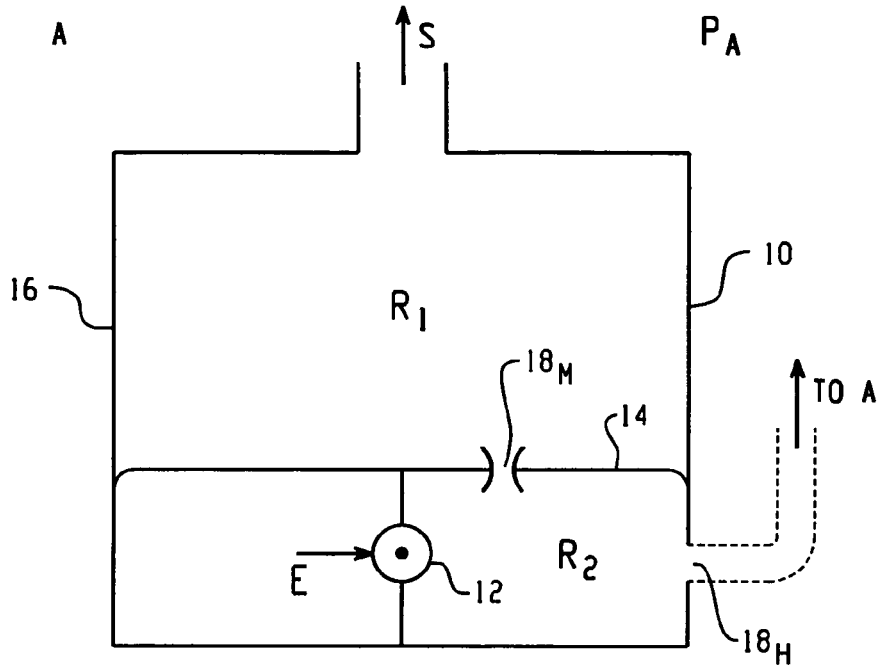

FIG. 3: In a representation in analogy to that of FIG. 1 or 2 a first embodiment of an electrical/acoustical converter according to the present invention.

Figure 4:
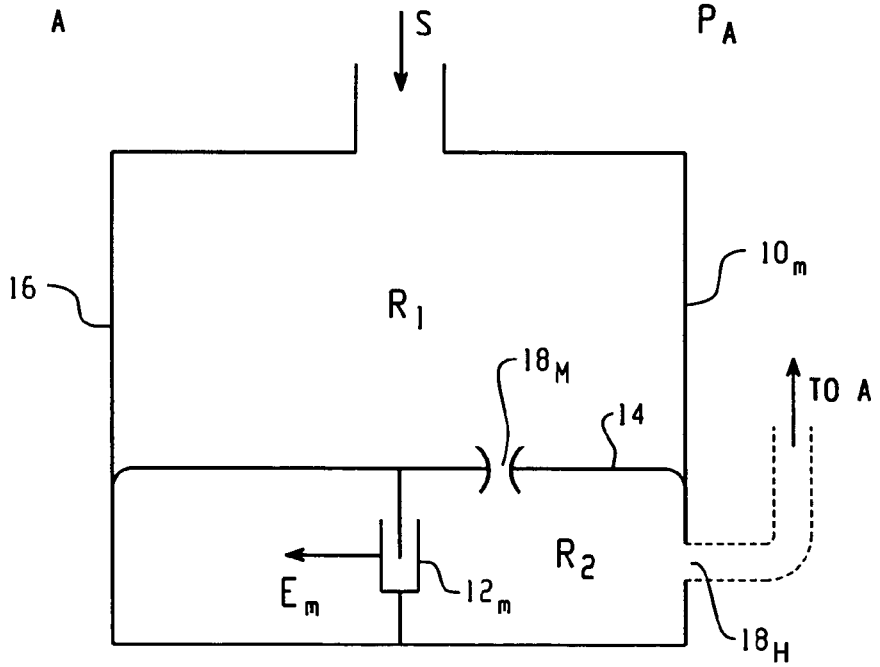

FIG. 4: Still in a representation in analogy to the previous figures the converter according to the present invention as of FIG. 3 conceived as an acoustical/electrical converter.

Figure 5:
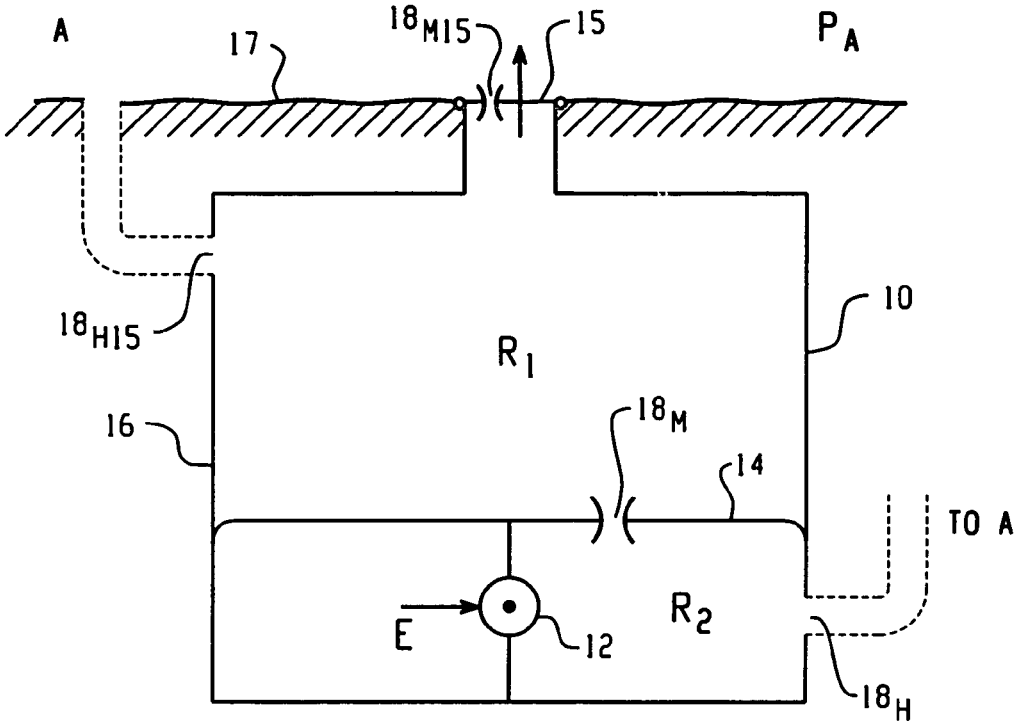

FIG. 5: A further preferred embodiment of an electrical/acoustical converter according to the present invention.

Figure 6:
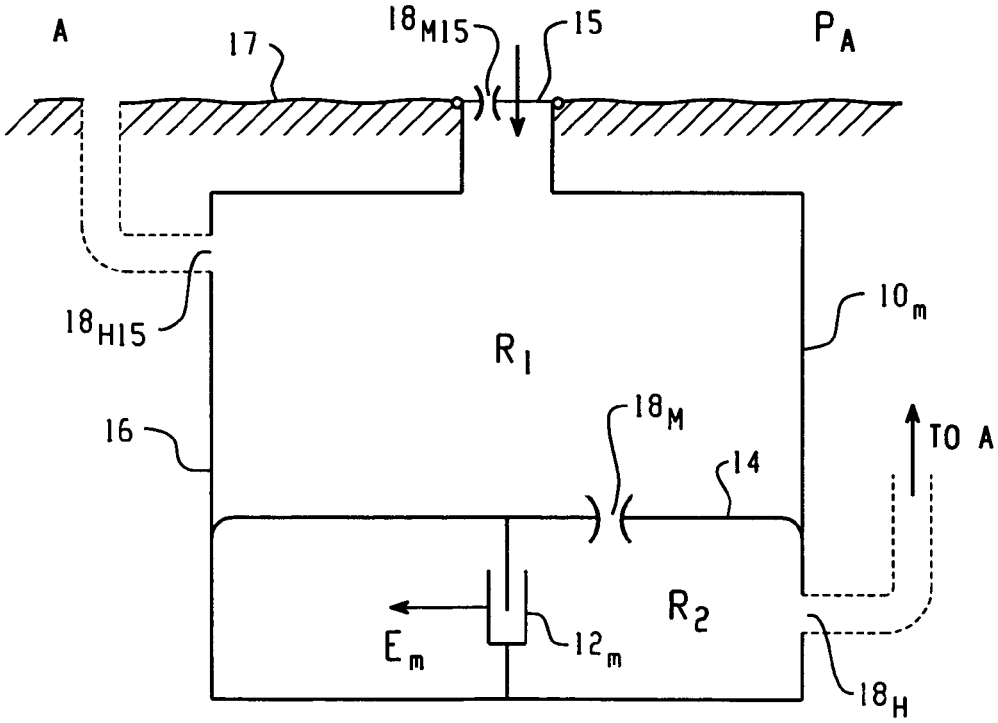

FIG. 6: Still in the same representation form the converter according to the present invention and as shown in FIG. 5 now conceived as an acoustical/electrical converter.

FIG. 3 shows schematically and in a representation according to the FIGS. 1 and 2 a first embodiment of an output electrical/acoustical converter according to the present invention. An output converter 10, a loudspeaker, comprises an electro-motoric drive 12 with an electrical input E. The drive 12 mechanically acts on a membrane 14. The membrane 14 separates two spaces $R_1$ and $R_2$ within a casing 16. Space $R_1$ is in open communication S with the ambient A of a hearing device wherein the converter 10 is implemented.

The second space $R_2$ is, according to the present invention, in communication with ambient A too. This is achieved by at least one passage $\mathbf{18}_M$ through the membrane 14 and/or by means of a at least one passage $\mathbf{18}_H$ in the casing 16 and the adjacent structure of the hearing device (not shown). The passages $\mathbf{18}_M$ and/or $\mathbf{18}_H$ are provided to establish communication with ambient A from the second space $R_2$ and are conceived so as to act as substantially not existing for acoustical signals within the hearable spectrum range whereas for acoustical signals i.e. pressure variations which occur below that range the passages $\mathbf{18}_M$ and/or $\mathbf{18}_H$ are open. Thus, the passages $\mathbf{18}_M$ and/or $\mathbf{18}_H$ act with respect to acoustical signals as low-pass acoustic impedance elements.

This is valid for the embodiment according to FIG. 3 but also for all the embodiments of the invention which will be further disclosed.

Further and so as to achieve such impedance behaviour of the passages $\mathbf{18}_M$ the one or preferably multitude of such passages $\mathbf{18}_M$ provided in the membrane 14 has under consideration of standard thickness of such membrane preferably a diameter D for which there is valid $$10\ \mu m \leqq D \leqq 30\ \mu m$$

thereby especially preferred $$D = \text{approx. } 20\ \mu m.$$

In spite of the fact that according to FIG. 3 the addressed membrane 14 is in fact the acoustic signal generating membrane and therefore its thickness, material and tensioning status will primarily be dictated by its function to convert the mechanical drive signal of motoric drive 12 to an acoustical signal, it might be advisable to conceive such membrane $\mathbf{14}_1$ too of silicon or polyurethane. Especially than the above advised diameter mentioned is proposed.

It must be stated with an eye on the passages $\mathbf{18}_M$ and $\mathbf{18}_H$ as of FIG. 3, that both of them or just one of them may be provided thereby as mentioned with respective multiples.

Especially when providing passages $\mathbf{18}_M$ through the membrane 14, in the preferred embodiment there is provided a multitude of such passages arranged in a pattern along membrane 14.

Thereby the more than such passages $\mathbf{18}_M$ are provided, the smaller the diameter of single passages will be selected as their acoustic impedance appear in parallel through membrane 14.

In FIG. 4 there is shown, with the same representation as in FIG. 3, an acoustical/electrical input converter, thus a microphone $\mathbf{10}_m$. Instead of the motoric drive 12 controlled by an input electrical signal E as of FIG. 3, there is provided an acoustical/electrical pick-up $\mathbf{12}_m$ and accordingly there is generated an output electric signal $E_m$. The remaining structure of the input converter $\mathbf{10}_m$ is equal to that of FIG. 3 and so are the respective consideration with respect to provision of the passages. Therefore the same reference numbers are used in FIG. 4 for the elements already described in context with the output converter 10 of FIG. 3.

According to FIG. 5 which is again an output converter 10 as of the embodiment of FIG. 3 and whereat the same reference numbers have been introduced for the elements which were already described in context with FIGS. 3 and 4, the first space $R_1$ is separated from ambient A by a additional further membrane 15. This membrane 15 accords with membrane 17 according to FIG. 2.

Such additional membrane 15 is provided as is disclosed in the above-mentioned prior art so as to prevent dirt as i.e. cerumen to penetrate into space $R_1$ and/or so as to specifically tailor the acoustical impedance as now becomes possible by the concept according to the present invention.

As shown in FIG. 5 and especially with an eye on contamination prevention and thus on facilitating cleaning, the additional membrane 15 especially in hearing aid appliances is provided substantially flush with the schematically shown outer surface 17 of the housing of the hearing devices. The additional membrane 15 may thereby be easily removable and replaceable or may be removable to be remotely cleaned and rearranged at the device. Further, be it to additionally facilitate cleaning of the membrane and/or to accurately realize a specifically desired impedance behaviour the membrane 15 which is preferably made of silicon or of polyurethane is coated on its outer and/or inner side, thereby preferably with a metallic layer. Such a metallic layer may additionally act as an electro-magnectic shield (not shown) if connected to the electric reference potential of the device's electronics.

Nevertheless and as may be seen from FIG. 5 by provision of such additional membrane 15 the first space $R_1$ becomes sealed with respect to ambient A. Therefore in analogy to the considerations with respect to the second space $R_2$ in context with the FIGS. 3 and 4, there is provided either in the additional membrane 15 and/or in the structure surrounding the space $R_1$, one or more than one passages $\mathbf{18}_{M15}$ and/or $\mathbf{18}_{H15}$ establishing a low-pass acoustical impedance characteristic communication between the first space $R_1$ and ambient. With respect to dimensioning such passages $\mathbf{18}_{H15}$ and/or $\mathbf{18}_{M15}$ as of FIG. 5, the same considerations are valid which were described in context with FIGS. 3 and 4.

In FIG. 6 there is shown, in analogy to FIG. 4 in context with FIG. 3, the embodiment of the output converter as of FIG. 5 now conceives as an input converter.

From the consideration of the inventive embodiments according to FIGS. 3-6, it becomes clear that whenever ambient pressure $P_A$ (t) varies i.e. due to an individual carrying the respective device changing its local altitude or due to meteorological pressure variations, without providing the passages according to the present invention, the membranes or the single membrane would be differently biased so as to establish in both spaces which are separated by such membrane the same pressure. If i.e. in FIG. 5 and without providing the passages, the ambient pressure $P_A$ (t) rises this leads to membranes 14 and 15 being biased downwards and to establish in both spaces R1 and R2 the same increased pressure $P_A$ (t). This on one hand changes the acoustical impedance defined by the membranes and may also change the working point of the motoric drive 12.

It becomes clear that more than one additional membrane as of 15 of the FIG. 5 or 6 may be provided serially staggered one behind the other and separating respective spaces. All such spaces must be inventively in communication with ambient by respective low-pass passages.

The invention claimed is:

1. A hearing device with an electrical/acoustical output converter, the output converter having a first flexible membrane mechanically coupled to an electric drive of said converter and separating two spaces, both spaces communicating with ambient respectively by at least one passage substantially blocking acoustical signals in the range of hearable spectrum and being substantially open for acoustical signals below said spectrum range, said spaces being sealed except for said at least one passage, one of said spaces communicating with ambient via a second flexible membrane.

2. A hearing device with an acoustical/electrical input converter, the input converter having a first flexible membrane to pick up acoustical signals and separating two spaces, both spaces communicating with ambient respectively by at least one passage substantially blocking acoustical signals in the range of hearable spectrum and being substantially open for acoustical signals below said spectrum range, said spaces being sealed except for said at least one passage, one of said spaces communicating with ambient via a second flexible membrane.

3. The device of claim 1 or 2, wherein one of said membranes is mechanically coupled to an electric drive or a pick-up.

4. The device of claim 1 or 2, wherein at least one of said membranes is a freely suspended membrane.

5. The device of claim 1 or 2, wherein said respective at least one passage is provided through one of said membranes.

6. The device of claim 1 or 2, wherein said respective at least one passage includes an additional passage through one of said membranes.

7. The hearing device of claim 1 or 2, wherein said respective at least one passage has a diameter D for which there is valid $10\ \mu m \leqq D \leqq 30\ \mu m$.

8. The device of claim 1 or 2, wherein at least one of said membranes is arranged substantially flush with an outer surface of said device.

9. The device of claim 1 or 2, wherein at least one of said membranes is substantially made of one of silicon and of polyurethane.

10. The device of claim 1 or 2, wherein at least one of the surfaces of at least one of said membranes is coated.

11. The device of claim 1 or 2, wherein the device is an outside-the-ear hearing device.

12. The device of claim 1 or 2, wherein the device is an in-the-ear hearing device.

13. The device of claim 1 or 2, wherein the device is a hearing aid device.

14. The device of claim 1 or 2, further comprising more than two of said membranes and of said two spaces.

15. A hearing device comprising:

an input or an output converter;

a first flexible membrane substantially separating a first space from a second space within said device, said first flexible membrane being mechanically coupled to said input or said output converter;

a second flexible membrane at least partially sealing said first space from ambient, wherein said first space communicates with ambient via a first passage, and wherein said second space communicates with ambient via said first passage or a second passage, wherein at least one of said first passage and said second passage substantially blocks acoustical signals in the range of hearable spectrum and is substantially open for acoustical signals below said spectrum range.

16. The hearing device of claim 15, wherein one or both of said first membrane and said second membrane has an additional passage therethrough, wherein one or both of said first space and said second space communicate with ambient through a combination of said additional passage with one or both of said first passage and said second passage.

* * * * *

UNITED STATES PATENT AND TRADEMARK OFFICE

CERTIFICATE OF CORRECTION

PATENT NO. : 7,305,098 B2
APPLICATION NO. : 10/155000
DATED : December 4, 2007
INVENTOR(S) : Andi Vonlanthen et al.

It is certified that error appears in the above-identified patent and that said Letters Patent is hereby corrected as shown below:

Column 1, line 50: Please delete "Converter", and insert therefor --converter--.

Column 1, line 67: Please delete "$R_1$", and insert therefor --$R_2$--.

Signed and Sealed this

Twenty-seventh Day of May, 2008

JON W. DUDAS
*Director of the United States Patent and Trademark Office*